United States Patent [19]

Suter

[11] 4,006,364

[45] Feb. 1, 1977

[54] TOUCH PAD ARRANGEMENT FOR SIGNALLING ARRIVALS IN SWIMMING COMPETITIONS

[75] Inventor: Max Suter, Dotzigen, Switzerland

[73] Assignee: Societe Suisse pour l'Industrie Horlogere Management Services, S.A., Bienne, Switzerland

[22] Filed: Sept. 30, 1975

[21] Appl. No.: 618,037

[30] Foreign Application Priority Data

Oct. 16, 1974 Switzerland ..... 13856/74

[52] U.S. Cl. ..... 307/119; 340/323 R; 273/86 B

[51] Int. Cl.[2] ..... G08B 5/22

[58] Field of Search ..... 307/112, 113, 115, 116, 307/119, 139, 149, 120; 340/323; 273/86 B; 272/4, 59 R, 59 A

[56] References Cited

UNITED STATES PATENTS 3,363,243 1/1968 Morley ..... 340/323

3,544,989 12/1970 MacCreadie ..... 340/323

3,916,214 10/1975 Coble, Jr. ..... 307/119

*Primary Examiner*—Herman Hohauser

*Attorney, Agent, or Firm*—Griffin, Branigan & Butler

[57] ABSTRACT

A plurality of contacts, each comprising two electrodes, are arranged behind a plate to be used as a touch pad in a swimming competition timing device. Closing of a contact results in a signal being transmitted from a transistor to control electronic chronometric equipment. The contacts are connected in parallel and are coupled between the emitter and base of the transistor. The voltage across the contact is thereby held to the base-emitter voltage of the transistor, which is below the decomposition voltage of the electrodes. In a second embodiment, contacts are connected to either of two transistors which are in series to act as an "OR" circuit.

8 Claims, 7 Drawing Figures

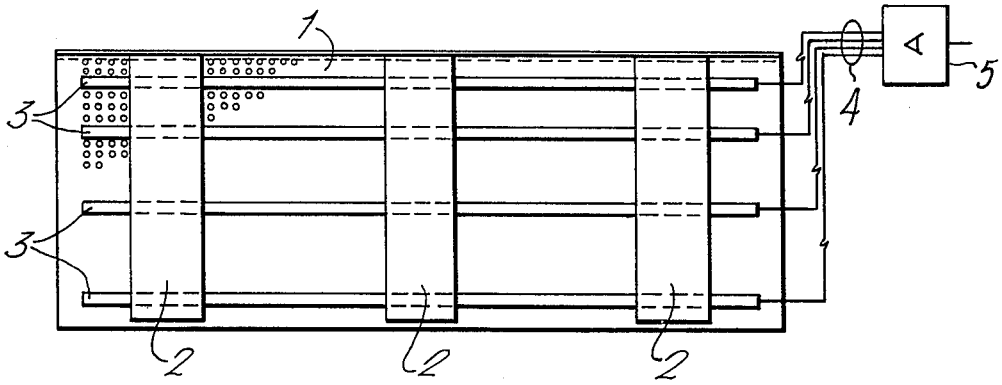
FIG. 1a
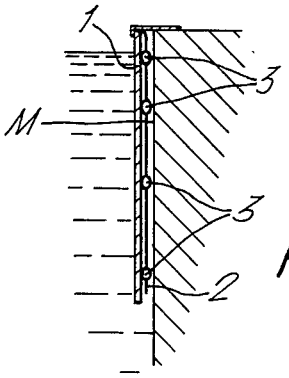
FIG. 1b
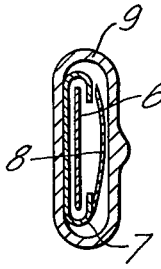
FIG. 2b
FIG. 2a
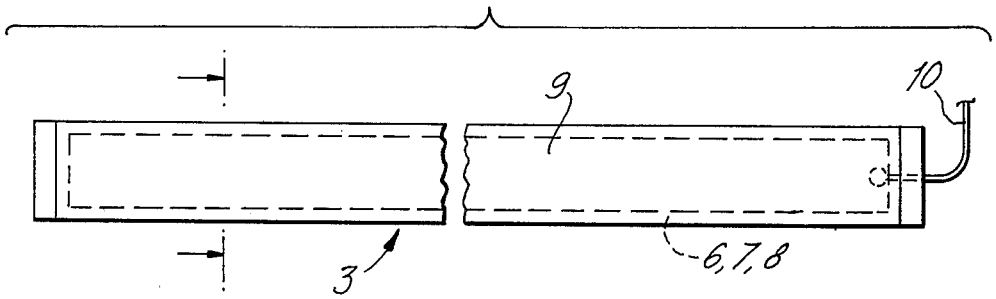

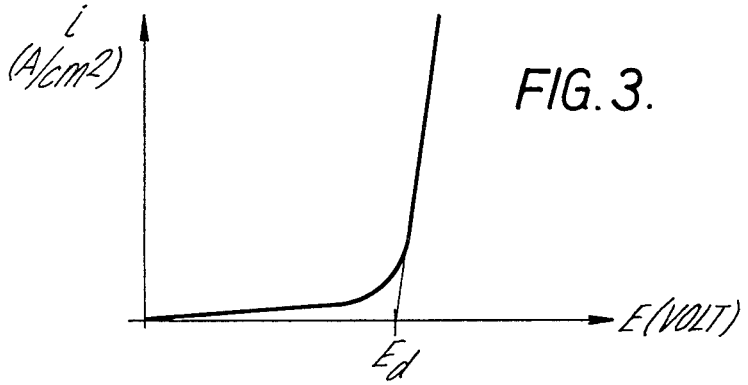
FIG. 3.
FIG. 4.
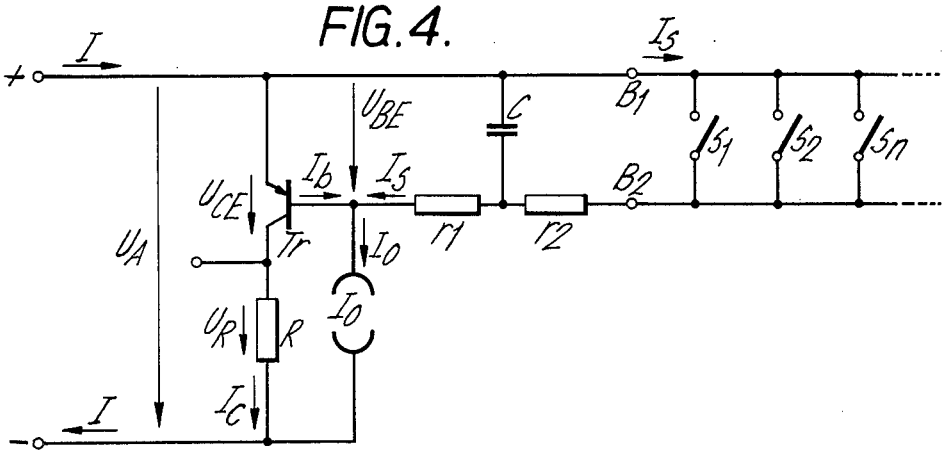
FIG. 5.
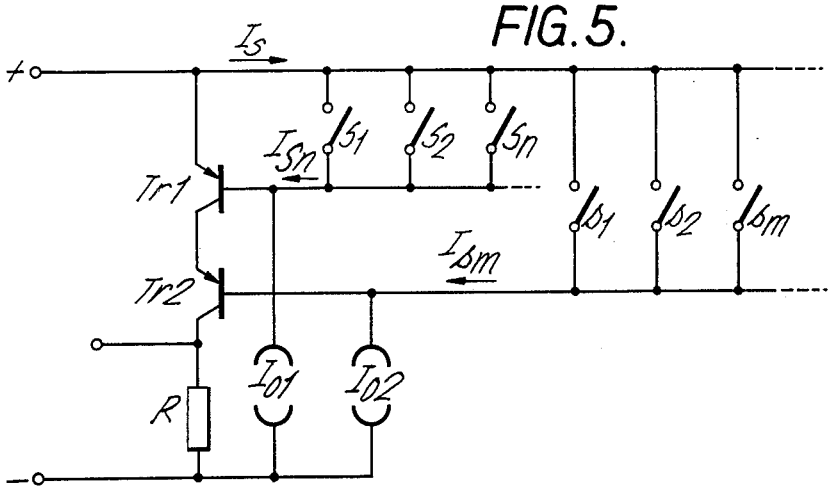

TOUCH PAD ARRANGEMENT FOR SIGNALLING ARRIVALS IN SWIMMING COMPETITIONS

The invention concerns an electrical contact arrangement in association with a touch pad used to detect the arrivals during swimming competitions and in particular concerns an electronic circuit for the development of an arrival signal to be used in relationship with a chronometric installation.

In installations of this type a perforated touch pad is suspended in the swimming pool at the end of the lane reserved for each competitor. This pad bears in general a predetermined number of contact strips formed of flat conductors elastically held at a distance from one another. A pressure exerted at one point of the pad will bring about compression of at least one of these contact strips between the pad and the arrival surface of the swimming pool and thereby the closing of an electric circuit by means of contact between the conductors within the strip. According to the various types of installations the conductors which may or may not be formed from the same material are suspended directly in the water of the pool or alternatively are enclosed within a sealed elastic sleeve. In the first case there has to be taken into consideration certain phenomena arrising from natural corrosion due to the materials used and to this must be added those phenomena of corrosion resulting from the fact that the supply voltage of the conductors utilized up to the present time (often 6 or 12 V) is much above the voltage of decomposition in water of the conductors or electrodes (1.2 Volts). The duration of these installations is thus rather short. In the second type of installation where one uses sealed elastic sleeves the problem in principal should not arise but the material of the sleeves will certainly show a tendence to age and lose little by little its impermeability or may otherwise be accidentally damaged, from where eventually the same phenomena may appear and may not be noticed by the user of the apparatus since the sleeve will conceal the damages.

The invention has for a purpose to overcome these difficulties by providing an electric contact arrangement and in particular an electronic circuit for such an arrangement comprising contact strips formed from conductors or electrodes enclosed in sleeves which are preferably watertight but are capable of operating perfectly and without the appearance of electrolytic corrosion even if the conductors are totally or partially immersed in the water of the pool. This purpose is attained by the use of at least one transistor arranged to clamp the contacts to a voltage below the decomposition voltage of the electrodes forming the contacts, this transistor being further adapted to amplify the voltage variation arising from the closing of a contact and at the same time to modulate the electric supply current.

For a better understanding of the following description reference will now be made to the drawings in which:

FIGS. 1*a* and *b* represent a face and side view of a touch pad arranged in a swimming pool.

FIGS. 2*a* and *b* show in elevation and in cross section the construction of a contact strip used within the touch pad of FIG. 1 and which may further be used in the present invention.

FIG. 3 is a graphical representation of the current density as a function of the voltage between the immersed conductors within a contact strip.

FIG. 4 is a schematic presentation of the electronic circuit in conformity with the invention and FIG. 5 shows a variation of the circuit of FIG. 4.

The installation as shown in FIG. 1 comprises in a well-known fashion a perforated plate 1 preferably formed of a semi-rigid plastic material of a height and width conforming to regulations and which is suspended in any suitable manner at the end of a swimming pool along the arrival surface of a swimming lane. Behind pad 1 contact strips 3 are fastened horizontally at various points with a predetermined separation by means of suspension strips 2 transversally arranged relative to pad 1. Electric connecting wires 4 for contact strips 3 are led from one side upwardly to an electronic arrangement 5. As shown in FIG. 2 each contact strip 3 may be formed of a conductive band 6, for example a thin and flexible metallic strip, which in relaxation is isolated along its entire length in an appropriate manner from a second conductive strip 8, likewise thin and flexible and which exhibits a slight concavity towards the interior. The two conducting strips 6 and 8 are maintained parallel and in proximity over their entire length by a plastic sleeve 9 which surrounds them preferably in a sealed fashion thereby to prevent dirt or water entering between the two conductive strips 6,8. At one end of each contact strip 3 two insulated wires 10 couple each of the two conductive strips 6,8 to an exterior circuit not shown in the drawings. Any pressure exerted on the contact strip 3 will bring about an electric contact of the two conductive strips 6,8 thereby bringing about a change of state which may be detected by circuit 5. When the pressure from the outside ceases the conductive strips 6,8 will turn to their initial position.

On referring back to FIG. 1 it will be seen that an external pressure exerted for example by a swimmer at any point of the perforated touch pad 1 will have as an effect to squeeze the one or more contact strips 3 between the pad 1 and the wall of the swimming pool 11 thereby short circuiting the connecting conductors 10. The resulting electric signal will be used to control operations of a chronometric installation.

If one or more sleeves 9 are damaged for any reason whatsoever the conductive bands 6,8 within the contact strips 3 may be partially or entirely immersed in the water of the swimming pool and this may hinder or render uncertain proper operation of the installation.

The circuit of the present invention enables detection at all times if at least two conductive strips 6,8 (called hereinafter electrodes) are in contact or if to the contrary no contact exists, no matter what conditions may exist within the one or several contact strips 3.

For better understanding of the functioning of the circuit it will be found convenient to refer briefly to the behaviour of electrolytes through reference to FIG. 3. If a voltage (E) is applied between two electrodes immersed within an electrolyte an electric current will flow in the closed circuit through migration of ions. For a low voltage (E) no visible precipitation of material will take place at the electrodes and the intensity or current density (*i*) is practically inexistent, one may consider the arrangement to be polarized. If little by little voltage (E) is increased the intensity initially increases very little but then following crossing of a threshhold entitled "decomposition voltage" (E*d*) and the voltage (E) continuing to increase the current intensity (*i*) increases suddenly and a material precipitation ever more important becomes evident.

This decomposition voltage is for water in the order of 1.2 V (see for example W. Feitknecht: Grundriss der allgemeinen und physikalischen Chemie, Chapter 8, Electrochemie).

In considering these various factors for conductive strips for electrodes 6,8 partially or totally immersed in the swimming pool water it is evident that there is every interest to maintain between them an applied voltage which in no case will exceed the decomposition voltage (E*d*) in order to avoid the deterioration of the electrodes. To this end the current may be kept fairly low. Parallel parasitic resistance is then fairly elevated and the dynamic resistance of the water moreover is greater below than above the voltage of decomposition. The discrimination between the closed or open state of electrodes 6,8 is thereby facilitated.

In the circuit of FIG. 4 as in accordance with the invention the applied voltage between the conductive strips 6,8 represented by contacts ($S_l$) to ($S_n$) is lowered from the supply voltage ($U_A$) which for example might be 8 V to the base emitter voltage ($U_{BE}$) of a silicon transistor ($T_r$) that is to say about 0.7 V this being clearly lower than the decomposition voltage ($E_d$) of 1.2 V. It is obviously possible to use a germanium transistor or any other voltage limiting device.

Let us suppose contacts ($S_l$) to ($S_n$) are all open and immersed in water. The voltage at these contacts is $U_{BE} \approx 0.7$V, as determined for chlorinated water and as a function of the material of the contacts and their active surface, there is a current ($I_s$) which traverses the open contacts. A low pass filter (C, $r_1$, $r_2$), not necessary to the operation, is mounted between transistor ($T_r$) and contacts ($S_l$) to ($S_n$) and is intended to eliminate the effect of indesirable disturbances, such filter introducing through its resistances ($r_1$, $r_2$) only a negligeable voltage drop. To compensate for fluctuations in the supply voltage ($U_A$) which is not necessarily regulated and according to current practice may vary from 8 to 14 V, a source of constant current is connected between the base of transistor ($T_r$) and the negative supply terminal. The current supplied by this source ($I_o$) is chosen in a manner so as to exceed the current at the contacts ($I_s$) by the value of base current necessary to cause transistor ($T_r$) to conduct.

The collector-emittor voltage ($U_{CE}$) is then equal to the saturation voltage of the transistor ($U_{CEsat}$); and the supply current (I) is equal to the sum of the collector current $$I_c = \frac{U_R}{R} = \frac{U_A - U_{CEsat}}{R}$$ (*R* being the series resistance with the collector)

and of the constant current ($I_o$). The open state of all contacts ($S_l$) to ($S_n$) is thus characterized by:

$$U_{CE} = U_{CEsat}$$
$$I = I_c + I_o$$

If at least one of contacts ($S_l$) to ($S_n$) is closed the voltage at terminals ($B_1$) and ($B_2$) becomes virtually zero and the base current ($I_b$) ceases to flow. Transistor ($T_r$) being thus blocked the collector current ($I_c$) is likewise annulled. Thus there is now the situation:

$$U_{CE} = U_A$$
$$I = I_o$$

which characterizes the closed state.

If contacts ($S_l$) to ($S_n$) while open, are only partially or even not at all immersed by water as in principle is the case during normal conditions of functioning the current at the contacts ($I_s$) is proportionally reduced. This reduction is compensated by an increase of base current ($I_b$). At the limit when no contact is wet ($I_b$) arrives at the value ($I_o$) imposed by the constant current source (which may moreover by replaced by a resistor) and the precedingly mentioned relationships describing the functioning of the circuit with wetted contacts remain valid.

Should the current at the contacts ($I_s$) risk to become too great from the fact of too good conductivity of the water and where the sum of the parallel currents at several contacts becomes sufficiently important to be equivalent for the transistor ($T_r$) to one single closed contact one may, as shown in FIG. 5, transform the arrangement into a form of OR circuit having at least two transistors ($T_{r1}$) and ($T_{r2}$). According to this arrangement if one of the contacts ($S_l$) to ($S_n$) is closed transistor ($T_{r1}$) is inactive and if one of contacts ($s_l$) to ($s_m$) is closed transistor ($T_{r2}$) stops operation. With constant current sources ($I_{o1}$) and ($I_{o2}$) each parallel circuit functions in accordance with the example previously described.

It has been determined that the functioning of the arrangement as hereinbefore described is optimal when contacts (S) or conductive strips 3 are formed from stainless steel preferably low in carbon and rich in chromium and nickel.

From the relationships characterizing the states open or shut it is clear that these states may be put in evidence through measuring the voltage ($U_{CE}$) or of the supply current (I). In the first case a shunt is necessary just after the collector of the sole transistor ($T_r$) or of the last transistor of the series ($T_{r2}$) as shown in FIG. 5. The arrangement which will be preferably as close as possible to the touch pad 1 will then be coupled by three connecting wires to the chronometric installation. It is thus advantageous above all if the transmission lines are rather long to detect the modulation of current (I) which, in such case, will necessitate only a single cable with two conductors.

What we claim is:

1. A touch pad arrangement for signalling arrivals in swimming competitions by means of electrical contacts, each comprising two electrodes, wherein such contacts are arranged in parallel and coupled between the emitter and base of at least one associated transistor to thereby clamp a voltage across the contacts to a voltage below the decomposition voltage of the electrodes forming the contacts, said transistor being further connected in circuitry including an electric supply to amplify the voltage variation across the contact arising from the closing of a contact and at the same time to modulate the electric supply current in response to that voltage variation.

2. An arrangement according to claim 1 wherein a low-pass filter is interposed between the contacts and the associated transistor.

3. An arrangement according to claim 1 wherein a source of constant current is placed between the base and the collector supply of each transistor.

4. An arrangement according to claim 1 wherein a plurality of transistors of the same type are connected in series, each transistor being associated with a predetermined number of contacts.

5. The arrangement of claim 4, wherein a low pass filter is interposed between the contacts and each associated transistor.

6. The arrangement of claim 4 wherein a source of constant current is placed between the base and the collector supply of each transistor.

7. An arrangement according to claim 1, wherein the electrodes forming the contacts are fashioned from stainless steel.

8. An arrangement according to claim 7, wherein said stainless steel electrodes have a composition low in carbon and rich in chromium and nickel.

* * * * *